US009911548B2

(12) United States Patent
Dedina

(10) Patent No.: US 9,911,548 B2
(45) Date of Patent: Mar. 6, 2018

(54) ELECTRIC SWITCHING APPARATUS

(71) Applicant: Schneider Electric Industries SAS, Rueil-Malmaison (FR)

(72) Inventor: Gregory Dedina, Vourey (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/286,763

(22) Filed: Oct. 6, 2016

(65) Prior Publication Data

US 2017/0178826 A1 Jun. 22, 2017

(30) Foreign Application Priority Data

Dec. 17, 2015 (FR) ..... 15 62649

(51) Int. Cl.
*H01H 3/00* (2006.01)
*H01H 1/14* (2006.01)

(52) U.S. Cl.
CPC ..... *H01H 3/001* (2013.01); *H01H 1/14* (2013.01)

(58) Field of Classification Search
CPC ..... H01H 3/001; H01H 1/20–2001/2091
See application file for complete search history.

(56) References Cited

U.S. PATENT DOCUMENTS

| | | | | |
|---|---|---|---|---|
| 4,650,935 | A | 3/1987 | Ootsuka et al. | |
| RE33,457 | E | 11/1990 | Ootsuka et al. | |
| 6,400,242 | B1 * | 6/2002 | Fasano | H01H 71/465 200/18 |
| 2015/0096874 | A1 | 4/2015 | Dedina | |

FOREIGN PATENT DOCUMENTS

| | | |
|---|---|---|
| EP | 2 860 743 A1 | 4/2015 |
| FR | 2 237 295 | 2/1975 |
| GF | 2 169 143 | 7/1986 |

OTHER PUBLICATIONS

French Preliminary Search Report dated Aug. 19, 2016 in French Application 15 62649, filed on Dec. 17, 2015 ( with English Translation of Categories of Cited Documents).

* cited by examiner

*Primary Examiner* — Ramon M Barrera
(74) *Attorney, Agent, or Firm* — Oblon, McClelland, Maier & Neustadt, L.L.P.

(57) ABSTRACT

An electric switching apparatus including fixed contacts respectively supported by an upstream support and a downstream support and electrically connected to an upstream power line and to a downstream power line, respectively, the fixed contacts cooperating with respective upstream and downstream mobile contacts, each of the mobile contacts being supported by a support, the supports movable simultaneously in translation by a contact carrier controlled by an actuator. This apparatus includes a device for transforming, during a device opening operation in the presence of a microweld between one of the mobile contacts and the associated fixed contact, the movement in translation of the support associated with the mobile contact in a combined movement in translation and rotation of the mobile contact so as to exert at the points of contact between the mobile contact and the fixed contact a shear force capable of breaking the aforementioned microweld.

8 Claims, 7 Drawing Sheets

ELECTRIC SWITCHING APPARATUS

TECHNICAL FIELD

Figure 1:
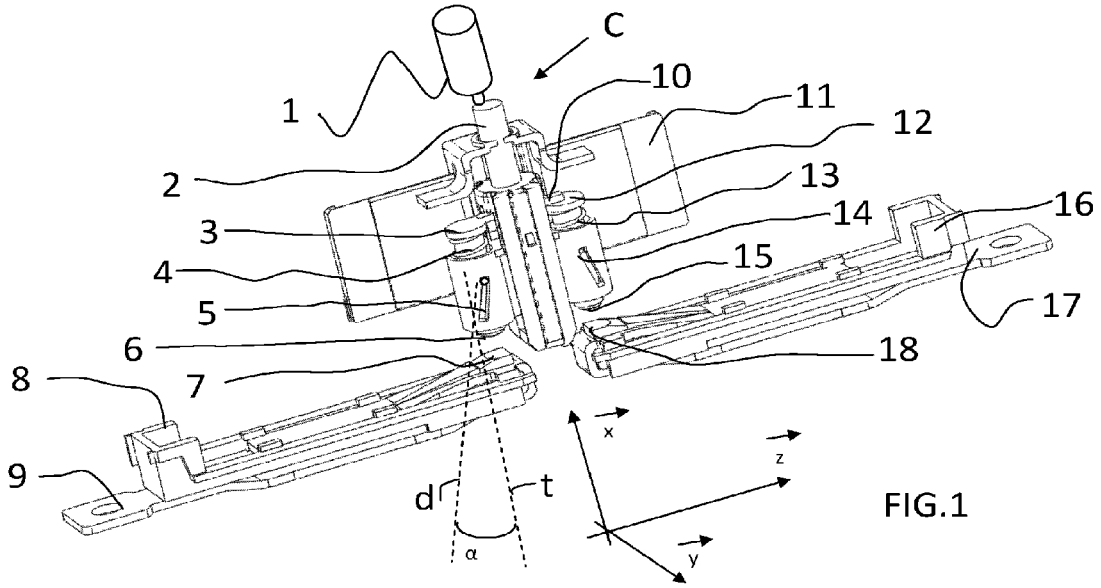

The present invention relates to an electric switching apparatus including, for each phase, an "upstream" fixed contact and a "downstream" fixed contact, said fixed contacts being respectively supported by an upstream fixed contact support and a downstream fixed contact support and being electrically connected to an upstream power line and to a downstream power line respectively, said fixed contacts being intended to cooperate respectively with two respective upstream and downstream mobile contacts, each of said mobile contacts being supported by a contact support, said contact supports being designed to be moved simultaneously in translation by a contact carrier, controlled by an actuator, between a first position, described as the contact opening position, in which the mobile contacts are separated from the respective fixed contacts, and a position described as the closing position, in which the mobile contacts are in contact with the respective fixed contacts, thereby establishing the electrical connection between the two power lines.

PRIOR ART

Today, electrical contacts may be mutually connected in the contact closing position by means of a microweld. Although this microweld does not exert a very high binding force, this force is sufficient to prevent the opening of the electrical contacts.

U.S. Pat. No. 5,343,174 describes an electric switch comprising means for the breaking of the weld, in the case of welded contacts.

In this document, upon each closing and/or opening of the electrical contacts, a device implementing cams drives the mobile contact in a translational movement in relation to the fixed contact. This relative translational movement between the fixed contact and the mobile contact permits the breakage of the welds formed between the contacts.

The solution described is associated with the premature wear of the contact pads, and is not compatible with the number of switching operations which this device is likely to execute.

Document FR 2608832 is also known, in which a switching device is described incorporating a mechanism which is designed to drive the mobile contact in a tilting movement in relation to the fixed contact, whereby the effect of this rolling movement of the mobile contact on the fixed contact is the breakage of the microwelds upon the opening of the contacts. In this embodiment, a twisting force is applied to the mobile contact in order to facilitate the detachment of the mobile contact from the fixed contact, wherein virtually the full amount of forces are applied for the tensile loading of the mobile contact.

This embodiment does not permit the breakage of microwelds which show substantial resistant forces.

DESCRIPTION OF THE INVENTION

The present invention resolves these problems, and proposes an electric switching apparatus incorporating means for the breakage of microwelds formed on the electrical contacts and which show substantial resistant forces, wherein said apparatus is also capable of executing a large number of switching operations.

To this end, the object of the present invention is a switching apparatus, said apparatus being characterized in that it comprises means for transforming, during an apparatus opening operation in the presence of a microweld between one of the mobile contacts and the associated fixed contact, the movement in translation of the contact support associated with the mobile contact into a combined movement in translation and rotation of the mobile contact so as to exert, at the points of contact between the mobile contact and the fixed contact, a shear force which is capable of breaking the above-mentioned microweld.

According to a particular feature, the above-mentioned contact supports are each mounted in a sliding arrangement in a guide component which is integral with the above-mentioned contact carrier, said guide component incorporating means for the angular guiding of a rod which is integral with the mobile contact associated with the support, said mobile contact assuming the movement in translation of its associated contact support such that, during an operation for the opening of the apparatus, a torque is transmitted to the microweld m by the rotation of the mobile contact around the axis of the above-mentioned translation, wherein said torque generates the above-mentioned shear forces.

According to a particular feature, these angular guiding means incorporate a slot which is provided in the guide component, said slot extending in an inclined direction and forming an angle in relation to the direction of the above-mentioned movement in translation, said slot cooperating with a rod which is associated with the mobile contact such that, during an operation for the opening of the apparatus in the presence of a microweld, a force is applied between the contact carrier and the guide slot at the point of contact between the rod and the guide slot, said force generating a torque on the guide component which results in the rotation of the mobile contact, said torque being transmitted to the microweld.

According to a further feature, this apparatus comprises, in association with each mobile contact, a spring which is designed to return said mobile contact to the opening position.

According to a further feature, the above-mentioned angle is between 0 and 90°.

According to a further feature, each slot comprises a first part, extending in a longitudinal direction which is inclined in accordance with the above-mentioned angle, followed by a second part extending in a direction which is substantially parallel to the above-mentioned direction of movement in translation, the first part being situated on the side of the fixed contacts, whereas the second part is situated on the opposite side, the first part being designed to cooperate with the rod during an opening operation in the presence of a microweld, and the second being designed to cooperate with the rod during a closing operation.

According to a further feature, this apparatus is a circuit breaker or a contactor.

According to a further feature, the contacts are power contacts or auxiliary contacts on the apparatus.

Figure 2:
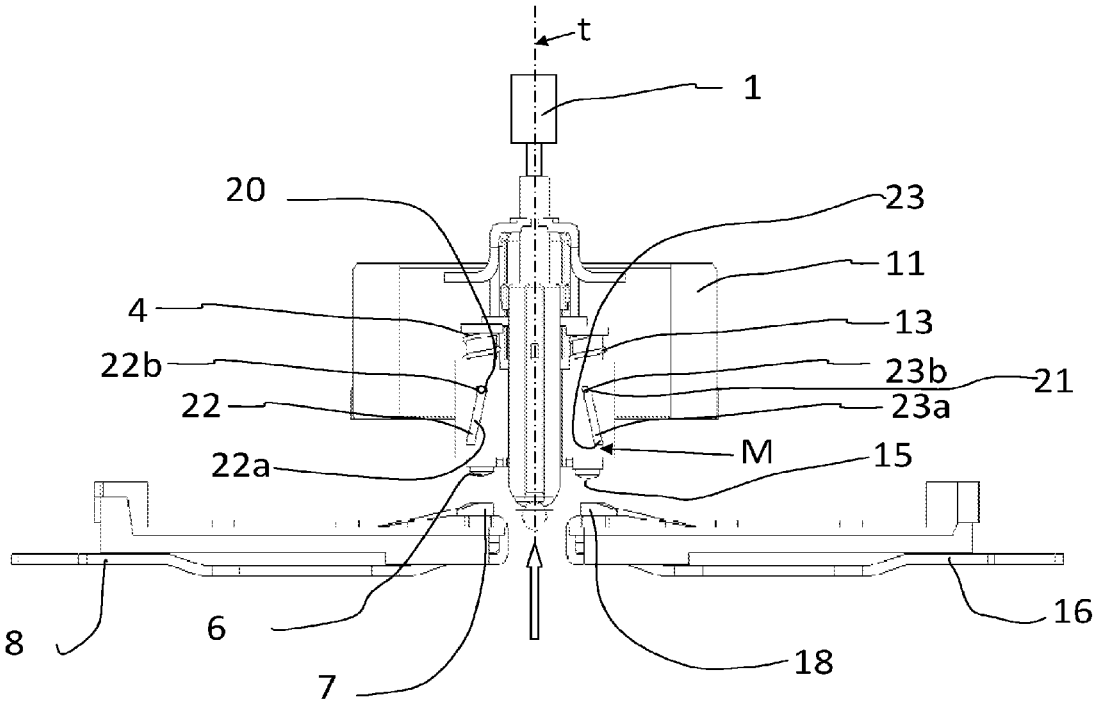
Figure 3:
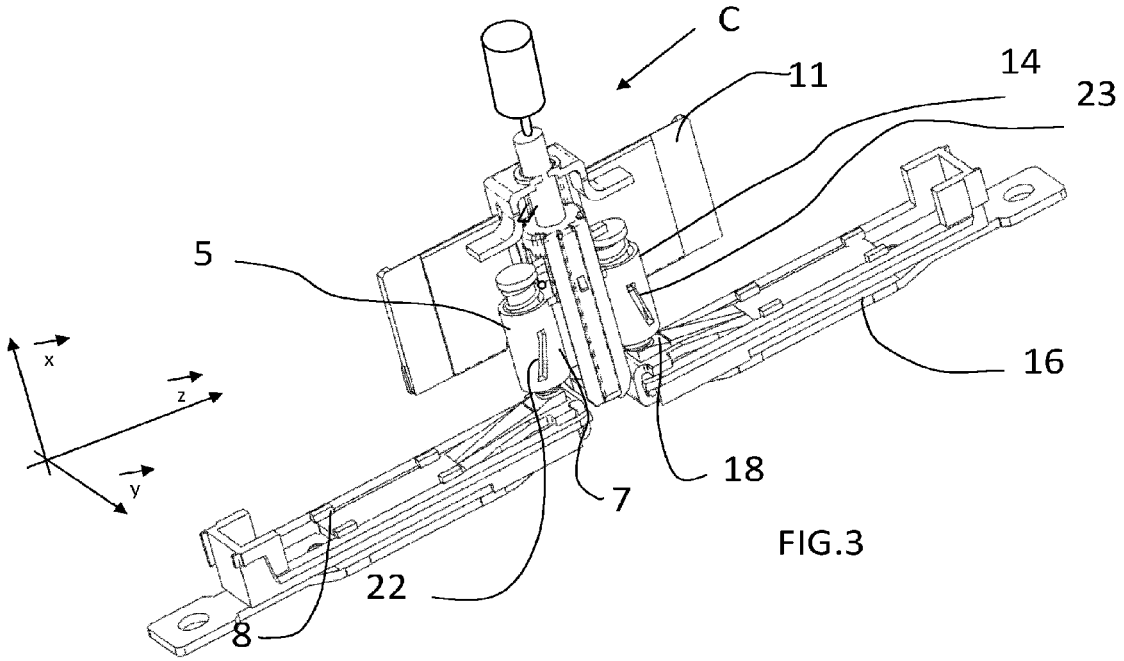
Figure 4:
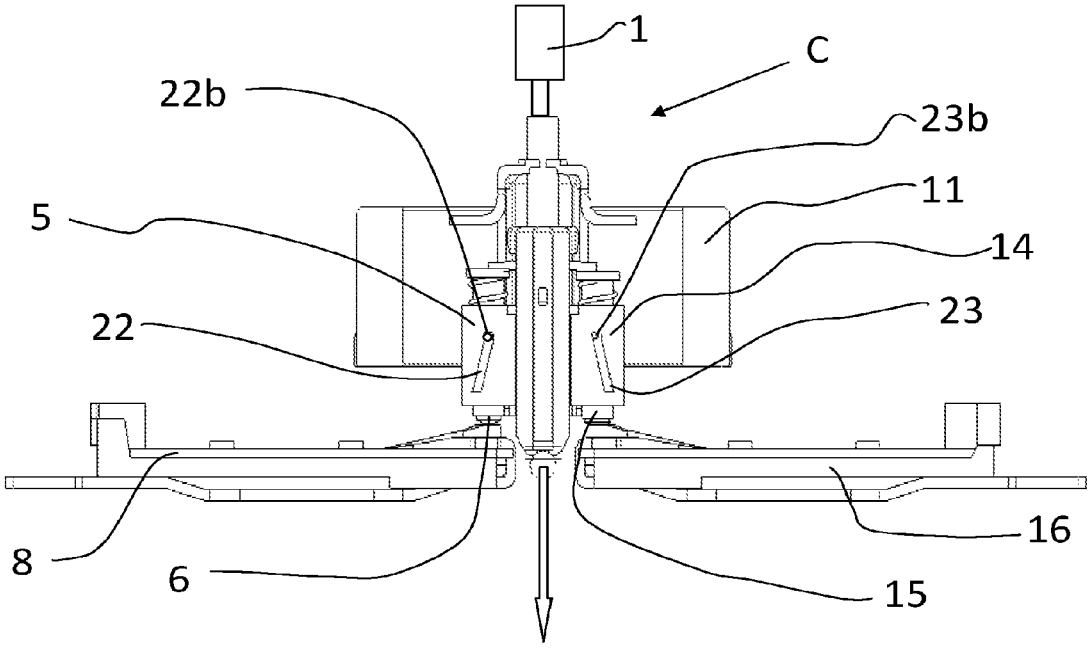
Figure 5:
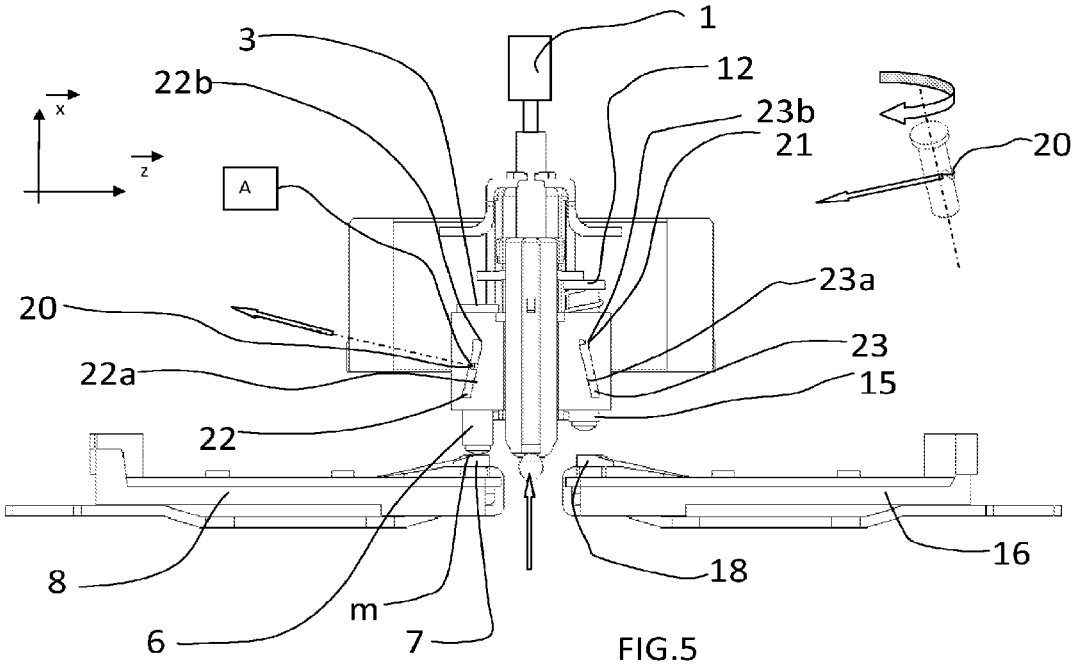
Figure 5A:
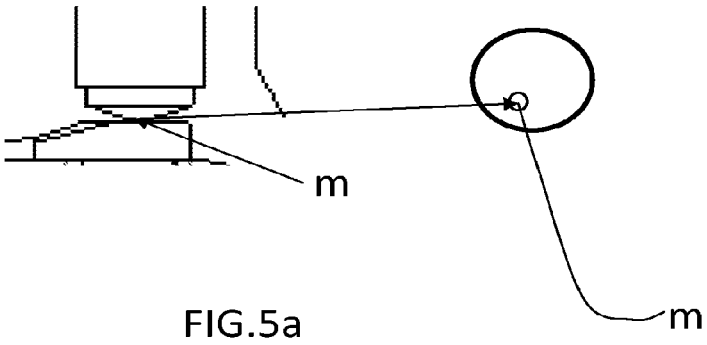
Figure 5B:
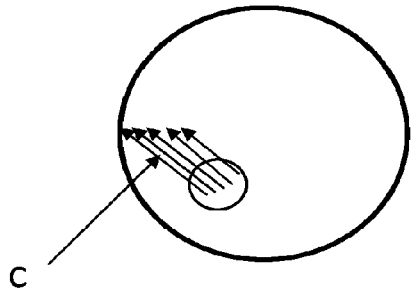
Figure 6:
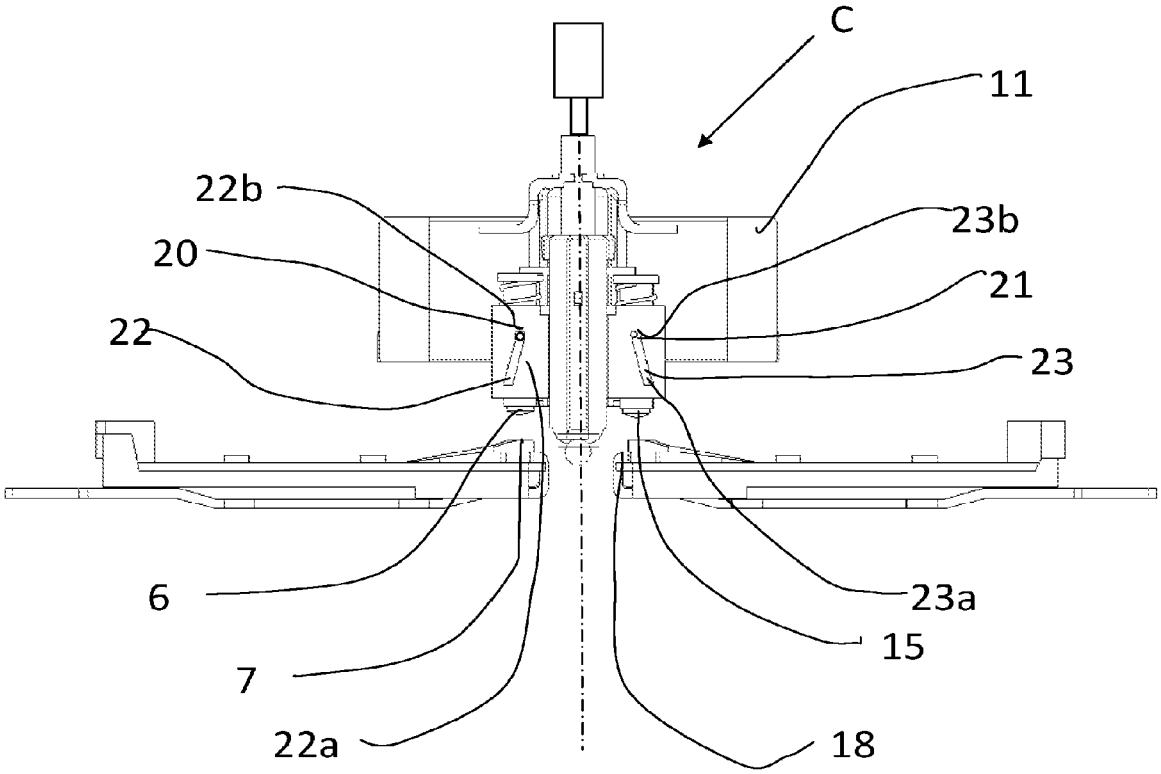

However, further advantages and features of the invention are more effectively clarified in the detailed description below, with reference to the attached drawings, which are provided by way of example only, and in which:

FIGS. 1 and 2 respectively illustrate a perspective view and a side view of part of an electromagnetic contactor according to a specific embodiment of the invention, with the contacts in the open position, FIGS. 3 and 4 show identical views to the preceding figures, with the contactor in the closed position, and FIGS. 5, 5*a*, 5*b* and 6 respectively show a side view, two schematic views and a side view respectively illustrating the contactor in an intermediate opening position, with one of the contacts welded in FIG. 5, the point of contact between a fixed contact and a mobile contact in FIG. 5*a*, the forces applied to a fixed contact in FIG. 5*b*, and a contactor in the open position in FIG. 6.

FIGS. 1 and 2 illustrate part of an electrical contactor C comprising, per phase, and accommodated in a "power" chamber 11 which is integral with the frame of the apparatus, a mechanical actuator 1 which is designed to control the movement of a mobile contact carrier 2, said contact carrier 2 carrying two supports 3, 12 respectively for two mobile contacts 6, 15, upstream and downstream respectively, electrically interconnected by means of an electric jumper 10, said two contact supports 3, 12 being designed to move at the same time in a direction which is substantially perpendicular to a plane containing the two fixed contacts 7, 18, said fixed contacts being designed to cooperate with said two mobile contacts 6, 15.

These two supports 3, 12 are mounted to slide respectively in two guide components 5, 14 of substantially tubular form, which are integral with the actuator 1.

Each of the supports 3, 12 for mobile contact 6, 15 is associated with a spring 4, 13 which is designed to return the mobile contact 6, 5 to the opening position, whereby each spring is interposed between said support and the corresponding guide component.

This contactor C also comprises two supports 8, 16 for two fixed contacts 7, 18, upstream and downstream respectively, said supports respectively carrying an upstream fixed contact 7 and a downstream fixed contact 18, said upstream 7 and downstream 18 fixed contacts being situated respectively opposite the above-mentioned upstream 6 and downstream 15 mobile contacts, these two fixed contacts being electrically connected respectively to an upstream power line 9 and a downstream power line 17.

According to the invention, this contactor C comprises means for transforming, upon the opening of the mobile contacts 6, 15 in the presence of a microweld between one of the fixed contacts and the corresponding mobile contact, the movement in translation of the mobile contacts 6, 15 into a movement in translation and rotation of said mobile contact, in order to exert upon any microweld m (FIG. 5*a*) formed between the mobile contact and the corresponding fixed contact a shear stress c (FIG. 5*b*) which is conducive to the breakage of the microweld m.

According to the specific embodiment illustrated in the figures, these means comprise two rods 20, 21, which are respectively integral with the two mobile contacts 6, 15, said rods 20, 21 extending substantially perpendicularly to the axis of the above-mentioned tubular parts 5, 14, said axis being substantially parallel to the axis of translation t of the supports 3, 12 for the mobile contacts in said guide components 5, 14. These two rods 20, 21 are designed to cooperate respectively with two slots 22, 23 provided respectively in the two guide components 5, 14.

Advantageously, as illustrated in the figures, these slots 22, 23 comprise a first part 22*a* extending in a direction (d) and forming an angle α in relation to the axis of the tubular portions 5, 14, followed by a second part 22*b* extending in a parallel axis to the axis of the corresponding tubular part, this second part being situated on the side opposite the fixed contacts 7, 18.

The operation of a contactor C according to the invention is described hereinafter, with reference to FIGS. 3 to 6.

In FIGS. 1 and 2, the apparatus is in the open position, the mobile contacts having been returned to the open position by the two springs respectively. In this position, the two rods 20, 21 are located respectively at the end of the two second parts 22*b*, 23*b* the slots 22, 23.

During the closing operation of the apparatus, the movement of the actuator 1 in the direction of the fixed contacts 8, 16 results in the movement in translation of the guide components 5, 14, which drive the mobile contact supports and the mobile contacts 6, 14 by means of the rods 20, 21 cooperating with the free edge of the second parts 22*b*, 23 of the slots 22, 23, until contact is formed between the mobile contacts and the respective fixed contacts.

In FIGS. 3 and 4, the contactor C is in the closed position, permitting the passage of current between the upstream power line 9 and the downstream power line 17.

In FIG. 5, an opening command for the power contacts has been delivered to the actuator, thereby resulting in the opening of only one 15 of the mobile contacts 6, 15, situated on the right-hand side of FIG. 5, given the presence of a microweld between the other 6 of the mobile contacts 6, 15 and the corresponding fixed contact 7. This position corresponds to a position for the start of breakage of the microweld m.

During this opening operation, the actuator 1 has driven the two guide components 5, 14 upwards.

During this control of the actuator 1, and consequently this movement of the contact carrier 2, the mobile contact 15 situated on the right-hand side of FIGS. 5 and 6, for which no microweld is present, will have been returned upwards by the corresponding spring 13, simultaneously with the upward movement of the corresponding guide component 14. Accordingly, in the opening position, the rod 21 associated with this mobile contact is located at the end of the second part of the slot 23*b*.

The other mobile contact 6, conversely, is connected to the corresponding fixed contact by a microweld which prevents the upward movement of this mobile contact simultaneously with the corresponding guide component 5.

Upon this upward movement of this guide component 5, the rod 20 of this mobile contact 6 moves in the first part 22*a* of the corresponding slot 22, thereby generating a movement in rotation of the mobile contact in an anti-clockwise direction, considered in FIG. 5 from below. This rotation also generates a shear stress c in the plane y, z (FIG. 3 and FIG. 5) at the interface between the mobile contact 6 and the corresponding fixed contact 7, thereby resulting in the breakage of the above-mentioned microweld.

Accordingly, where the actuator 1 is actuated in the direction x, the components 2, 5 are driven in the direction x. The spring 4 is compressed and, at the same time, a force is applied between the mobile contact carrier 2 and the upstream angular guide 5 at point A.

The application of this force generates a torque on this component. This torque is transmitted directly to the microweld m. The stresses applied to the microweld are essentially shear stresses, with a minor element of tensile stresses. These stresses will result in the failure of the microweld and the repositioning of the mechanism in the open position. The value of the force required to break this microweld can be set by the adjustment of the value of the angle α. Accordingly, the available tensile force is converted into a shear force.

The continuation of this opening movement of the actuator 1 permits the opening of the contactor C by the separation of the mobile contact 6 from the fixed contact 7.

Accordingly, the objective of the invention is the breakage of the microwelds m, in order to increase the service life of contacts, by the application of a relatively simple principle based upon the factual mechanical circumstance described below.

At present, for a given material, the modulus of longitudinal elasticity is higher than a transverse elastic coefficient.

At present, stresses applied to the microweld are tensile stresses, employing the modulus of longitudinal elasticity.

In electrical contacts, the very minor welding of contacts can occur, even though the contacts concerned are not entirely worn out.

Welding renders the operation of the product impossible, such that the replacement thereof is mandatory, thereby necessitating shutdowns for maintenance.

Accordingly, the material of the electrical contacts is not used in full, and noble materials are discarded.

One of the objectives of the invention is the exploitation of forces present during the opening of the contacts, without increasing these forces.

Thus, according to the invention, the available tensile force is converted into a shear force, thus permitting the transition from a modulus of longitudinal elasticity to a transverse elastic coefficient.

In practice, the use of available forces permits the omission of any change to overall product design.

Accordingly, the motor element for the opening of contacts (coils or other contacts) will retain the same features.

As microwelds may occur prior to the total or partial wear of the pads, the benefit associated with the limitation of shutdowns in production is considerable.

The invention can easily be deployed on existing products, without the need for complete redesign, thereby increasing and optimizing the service life of electrical contacts.

The invention is applicable to any electric switching apparatus, including a contactor, a circuit breaker, etc., comprising electrical contacts with simple pads, double-break contacts or other electric switching systems.

Conversely to devices from the prior art, the invention permits the virtually exclusive application of shear forces to the microweld, thereby permitting the breakage of microwelds showing resistant forces which are twice as high.

Naturally, the invention is not limited to the embodiments described and illustrated, which are provided for exemplary purposes only.

Conversely, the invention encompasses all technical equivalents of the means described, together with combinations thereof, where these are executed in the spirit of the invention.

The invention claimed is:

1. An electric switching apparatus comprising:

for each phase, an upstream fixed contact and a downstream fixed contact, said fixed contacts being respectively supported by an upstream fixed contact support and a downstream fixed contact support and being electrically connected to an upstream power line and to a downstream power line respectively, said fixed contacts being configured to cooperate respectively with two respective upstream and downstream mobile contacts, each of said mobile contacts being supported by a contact support, said contact supports being configured to be moved simultaneously in translation by a contact carrier, controlled by an actuator, between a first position, as a contact opening position, in which the mobile contacts are separated from the respective fixed contacts, and a second position as a closing position, in which the mobile contacts are in contact with the respective fixed contacts, thereby establishing the electrical connection between the two power lines, and a mechanism configured to transform, during an apparatus opening operation in a presence of a microweld between one of the mobile contacts and the associated fixed contact, the movement in translation of the contact support associated with the mobile contact into a combined movement in translation and rotation of the mobile contact so as to exert, at points of contact between the mobile contact and the fixed contact, a shear force which is capable of breaking the microweld, wherein contact supports are each mounted in a sliding arrangement in a guide component which is integral with the contact carrier, said guide component incorporating a mechanism configured to provide angular guiding of an element which is integral with the mobile contact associated with the support said mobile contact assuming the movement in translation of its associated contact support such that, during an operation for the opening of the apparatus, a torque is transmitted to the microweld by the rotation of the mobile contact around an axis of the translation, wherein said torque generates the shear forces.

2. The switching apparatus according to claim 1, wherein the element which is integral with the mobile contact associated with the support is a rod.

3. The switching apparatus according to claim 2, wherein the mechanism configured to provide the angular guiding a slot which is provided in the guide component, said slot extending in an inclined direction and forming an angle $\alpha$ in relation to the direction of the movement in translation, said slot cooperating with the rod which is associated with the mobile contact such that, during an operation for the opening of the apparatus in the presence of a microweld, a force is applied between the contact carrier and the guide slot at the point of contact between the rod and the guide slot, said force generating a torque on the guide component which results in the rotation of the mobile contact, said torque being transmitted to the microweld.

4. The switching apparatus according to claim 1, wherein, in association with each mobile contact, a spring which is configured to return said mobile contact to the opening position.

5. The switching apparatus according to claim 3, wherein said angle $\alpha$ is between 0 and 90 °.

6. The switching apparatus according to claim 3, wherein each slot comprises a first part extending in a longitudinal direction which is inclined in accordance with the said angle $\alpha$, followed by a second part extending in a direction thich is substantially parallel to the above-mentioned direction of movement in translation, the first part being situated on the side of the fixed contacts, whereas the second part is situated on the opposite side, the first part being designed to cooperate with the rod during an opening operation in the presence of a microweld, and the second being designed to cooperate with the rod during a closing operation.

7. The switching apparatus according to claim 1, wherein the apparatus is a circuit breaker or a contactor.

8. The switching apparatus according to claim 7, wherein the contacts are power contacts or auxiliary contacts on the apparatus.

* * * * *